US005205140A

United States Patent [19]

Nielsen et al.

[11] Patent Number: 5,205,140

[45] Date of Patent: * Apr. 27, 1993

[54] SUEDING MEANS IN A TEXTILE FABRIC-PRODUCING MACHINE

[75] Inventor: Majid N. Moghaddassi, Greensboro, N.C.

[75] Inventors: Arne Nielsen, Oak Ridge, Majid N. Moghaddassi, both of Greensboro, N.C.

[ * ] Notice: The portion of the term of this patent subsequent to Jun. 25, 2008 has been disclaimed.

[21] Appl. No.: 718,945

[22] Filed: Jun. 21, 1991

Related U.S. Application Data

[63] Continuation-in-part of Ser. No. 355,917, May 23, 1989, Pat. No. 5,025,644.

[51] Int. Cl.[5] ..... D04B 35/00; D06C 11/00

[52] U.S. Cl. ..... 66/147; 26/28; 242/18 R

[58] Field of Search ..... 66/147; 26/25, 27, 28, 26/29 R; 242/18 R, 18 DD, 45; 198/810, 814

[56] References Cited

U.S. PATENT DOCUMENTS

| | | | |
|---|---|---|---|
| 1,994,403 | 3/1935 | Reiners et al. | 242/18 R |
| 2,253,559 | 8/1941 | Curtin | 26/28 |
| 2,352,289 | 6/1944 | Rowe | 29/125 |
| 2,704,392 | 3/1955 | Schultz | 29/120 |
| 2,730,113 | 1/1956 | Hadley | 26/29 R |
| 3,001,682 | 9/1961 | Carroll et al. | 29/125 |
| 3,054,569 | 9/1962 | Weber et al. | 242/45 |
| 3,068,544 | 12/1962 | Connell et al. | 26/28 |
| 3,217,554 | 11/1965 | Stalker | 29/129 |
| 3,553,801 | 2/1968 | Hadley | 26/28 |
| 3,779,879 | 12/1973 | Dehne | 198/810 |
| 3,967,470 | 7/1976 | Miura et al. | 66/147 |
| 4,079,834 | 3/1978 | Fletcher, Jr. et al. | 198/810 |
| 4,512,065 | 4/1985 | Otto | 28/103 |
| 4,820,249 | 4/1989 | Wech | 29/125 |
| 5,005,270 | 4/1991 | Childers | 26/25 |
| 5,025,644 | 6/1991 | Nielsen et al. | 66/147 |

FOREIGN PATENT DOCUMENTS

| | | | |
|---|---|---|---|
| 2900246 | 7/1979 | Fed. Rep. of Germany | 26/28 |
| 0227992 | 10/1985 | German Democratic Rep. | 66/147 |
| 1257034 | 9/1986 | U.S.S.R. | |

OTHER PUBLICATIONS

Advertising brochure, Karl Mayer Textilmashinenfabrik GmbH, West Germ. entitled "Frottier-Kettenwirkautomaten Warp Knitting Machines for Terry Towelling," dated "Aug. 4, 1981 Sep. 1982".

Article entitled "Improved KS4FBZ Terry Tricot Machine for Made-Up Terry Hand Towels," Kettenwirk-Praxis, West Germany, Dated Mar. 1976.

Article, entitled "KS4F; KS4FB and KS4FBZ Terry Tricot Machines," Kettenwirk-Praxis, West German, dated Mar. 1984.

Advertising brochure, Sperotto SpA, Italy, entitled "SM.7 New Sueding Machines for Wovens and Knitteds," date unknown.

Advertisng brochure, Curtin-Herbert Co., Inc., Gloversville, Ny, entitled "Curtin-Hebert Co., Inc. 710 Series," date unknown.

Advertising brochure, Davis Gessner Company, Worcester, Mass., entitled "Sensi-Touch Cloth Sanding Machine," dated Jan. 1976.

*Primary Examiner*—Andrew M. Falik
*Assistant Examiner*—John J. Calvert
*Attorney, Agent, or Firm*—Shefte, Pinckney & Sawyer

[57] ABSTRACT

A textile warp knitting machine is equipped with a driven sandpaper-covered sueding roll extending the full width of the fabric take-up section of the machine for peripheral engagement of the warp knitted fabric with the sueding roll to produce a raised suede-like nap on one fabric surface. The sueding roll is driven oppositely to the direction of fabric travel. The fabric is guided to contact the sueding roll periphery at two opposite locations thereon. A dancer roller arrangement is provided, including a biasing arrangement for urging the dancer roll with a predetermined force into tensioning engagement with the traveling fabric. Additionally, the sueding roll drive is adapted to vibrate the traveling fabric to allow abraded particles to be released from the sueding roll. The sueding roll and fabric take-up roll drive motors are contained substantially entirely within the driven rolls themselves for improved compactness of the sueding arrangement.

10 Claims, 4 Drawing Sheets

SUEDING MEANS IN A TEXTILE FABRIC-PRODUCING MACHINE

CROSS-REFERENCE TO RELATED APPLICATIONS

This is a continuation-in-part of U.S. patent application Ser. No. 355,917, filed May 23, 1989, entitled "SUEDING MEANS IN A TEXTILE FABRIC-PRODUCING MACHINE," now U.S. Pat. No. 5,025,644.

BACKGROUND OF THE INVENTION

The present invention relates generally to textile processing apparatus adapted for developing a suede-like finish on a textile fabric and relates more particularly to a sueding arrangement for incorporation in a fabric-forming machine, such as a textile warp knitting machine.

In the textile industry, it is known to finish certain woven and warp knitted fabrics by abrading one or both surfaces of the fabric using a sandpaper or similarly abrasive material to cut and raise constituent surface yarns in the fabric into a closely raised nap producing a soft, smooth surface texture resembling suede leather. This operation, commonly referred to as sueding or sanding, is conventionally performed by a specialized fabric sueding machine wherein the fabric is passed under considerable tension over one or more finishing rolls covered with sandpaper or a similarly abrasive material which are rotated rapidly in the same direction as the fabric travels.

While conventional sueding operations produce satisfactory results in fabrics finished in this manner, several significant disadvantages of conventional sueding equipment detract from its desirability and economy. The relatively high rotational speeds at which the abrasive rolls of conventional sueding machines operate necessarily causes a substantial amount of fibrous lint and fly, fabric finish, abrasive dust and the like to be released from the fabric and the abrasive rolls, some of which may tend to become airborne posing a health hazard to machine operators, some of which may tend to become embedded in the interstices of the fabric detracting from its surface finish, and some of which may tend to accumulate on the abrasive surface of the finishing rolls tending to negate at least somewhat their abrasive sueding effect. To attempt to minimize these problems, conventional sueding machines are typically provided with relatively substantial suction-operated filtering arrangements for withdrawing liberated debris from the regions of the sueding rolls. Even so, the accumulation of debris on the sueding rolls generally occurs rapidly enough that it is commonly necessary to change the sandpaper or abrasive surface material on the rolls for every individual roll of fabric processed.

Additionally, conventional sueding machines are typically limited in their operational widths to the processing of fabrics no greater on average than 60 to 65 inches in width. In most conventional sueding machines, a nip roller or nose bar or another similar mechanical component is employed to hold the fabric against the rotating periphery of the sueding rolls along the full length of each roll and, accordingly, it is highly important that the sueding roll as well as the nip roll or nose bar be very true cylindrically to achieve uniform engagement and sueding effect along the full length of the sueding roll. As will thus be understood, it is highly impractical from an engineering design standpoint to utilize a sueding roll much greater in length than now conventional because the centrifugal forces present at the high rotational speeds at which such rolls operate together with the increased weight of a longer roll would naturally tend to cause deflection of the roll from a true cylindrical configuration as well as being more difficult to balance properly to minimize rotational vibration of the roll. On the other hand, many conventional weaving and warp knitting machines are available for producing fabrics in widths two to three times or more greater in width than the effective operating width of conventional sueding equipment. For example, warp knitting machinery currently in use is capable of producing warp knitted fabrics of 126 inches to 168 inches in width. Conventional weaving machines capable of producing fabrics of comparable widths are also available. Thus, when it is desired to produce a suede finish on fabrics of such greater widths than the maximum widthwise finishing capability of sueding machines, it is necessary to initially cut the fabric lengthwise into at least two smaller width lengths which are then individually processed through a sueding machine.

SUMMARY OF THE INVENTION

It is accordingly an object of the present invention to provide a sueding arrangement for incorporation in a textile weaving, knitting or other fabric-producing machine which forms fabrics in flat open-width form so that the fabric produced by such machines may be sueded as an integral part of the fabric forming operation, thus eliminating the need for a separate sueding operation, avoiding the disadvantages thereof, and realizing significant cost savings thereover.

Briefly summarized, the sueding arrangement of the present invention is operative for sueding the fabric in its full open-width form while on the textile fabric-producing machine intermediate the location on the machine of its mechanism for manipulating yarn to form the fabric and the following fabric take-up location of the machine. Basically, the sueding arrangement includes a sueding roll having an abrasive peripheral surface, a guide arrangement for directing the fabric to travel intermediate the yarn manipulating mechanism and the fabric take-up location in peripheral surface engagement with the sueding roll, and a drive for rotating the sueding roll at a peripheral surface speed compatibly related to the traveling speed of the fabric.

According to one aspect of the present invention, the guide arrangement includes a movable dancer roll arrangement for monitoring tension and speed fluctuations in the fabric as a basis for making suitable adjustments in the guide arrangement, e.g., adjusting the driven speed of the take-up rolls. The dancer roll arrangement includes a dancer roll and a biasing arrangement for urging the dancer roll with a predetermined force into tensioning engagement with the traveling fabric. Preferably, the dancer roll is supported for reciprocatory movement toward and away from the fabric, the biasing arrangement preferably being a dual-acting piston-and-cylinder assembly connected to the dancer roll supporting arrangement.

According to another aspect of the present invention, the sueding roll drive is adapted to vibrate the traveling fabric at its location of contact with the sueding roll sufficiently to allow abraded particles to be released from the sueding roll, thereby to extend the life of the sueding roll. In the preferred embodiment, the vibrating arrangement operates by periodically varying the driven speed of the sueding roll. Specifically, the vibrating arrangement delivers a fluctuating operating signal to a drive motor for the sueding roll, preferably by generating a main motor control signal and superimposing a square wave signal on the main motor control signal. It is further preferred that the fabric guide arrangement include first and second guide rolls respectively preceding and following the sueding roll, each of which is incapable of rotation in opposition to the direction of fabric travel, which assists in resisting any tendency for reverse fabric travel so that the drive speed fluctuations in the sueding roll act directly on the fabric.

In accordance with another aspect of the present invention, the sueding roll has a hollow drive end and the sueding roll drive includes a drive motor housed substantially entirely within the hollow drive end of the sueding roll. Preferably, a driven fabric take-up roll at the take-up location is similarly provided with a hollow drive end within which a drive motor is correspondingly housed. In this manner, the drive system required for operation of the present sueding arrangement is sufficiently compact that the sueding arrangement does not increase the overall widthwise dimension of the fabric-producing machine.

DESCRIPTION OF THE PREFERRED EMBODIMENT

Figure 1:
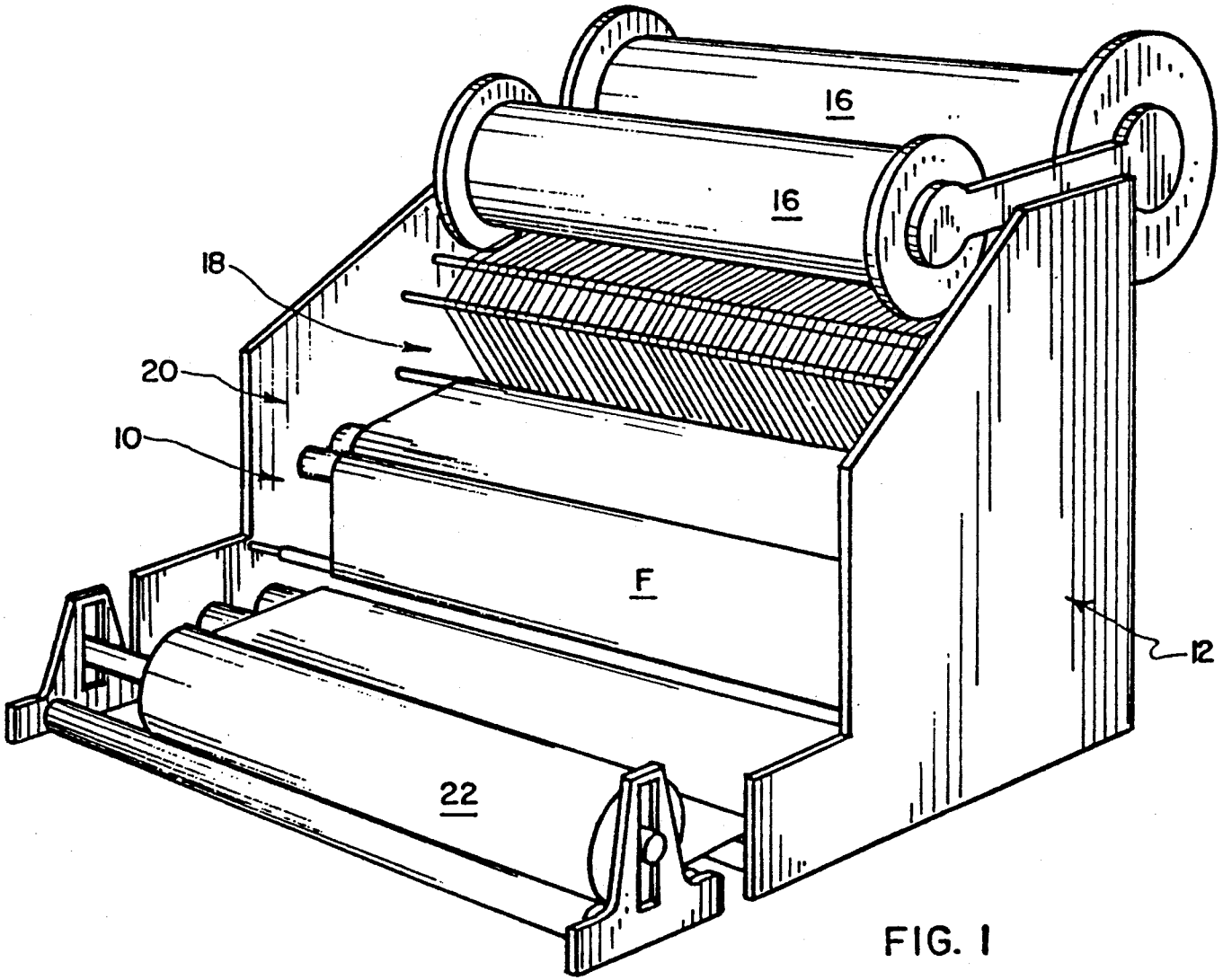
FIG. 1 is a perspective view of a textile warp knitting machine in which the sueding arrangement of the present invention is preferably embodied.

Referring now to the accompanying drawings and initially to FIG. 1, a sueding arrangement according to the present invention is indicated generally at 10 as preferably embodied in an otherwise conventional textile warp knitting machine, indicated at 12. The basic construction and operation of the warp knitting machine 12 is well known and therefore is not described in detail herein, except insofar as necessary to facilitate an understanding of the present sueding arrangement 10.

Basically, the warp knitting machine 12 has an extended elongate frame which supports at an overhead elevation a series of warp beams 16 having a plurality of warp yarns wound in side-by-side relation thereabout for feeding of the yarns in a sheet-like form downwardly to a knitting arrangement of a series of interactive yarn guide and needle bars, indicated generally at 18, for knitting manipulation of the yarns to form a fabric in flat open-width form, indicated at F, from which the fabric is directed through a fabric take-up section, indicated generally at 20, having a series of fabric guide rolls for directing the fabric for ultimate winding onto a storage roll 22. The maximum possible width to which the fabric F may be knitted by the warp knitting machine 12 is determined by the operative respective lengths of the yarn guide and needle bars of the knitting arrangement 18, as those persons skilled in the art will understand. As illustrated, the knitting machine 12 is representative of conventional warp knitting machines capable of knitting fabrics in widths up to 126 inches. However, it is to be understood that the sueding arrangement 10 of the present invention is equally adaptable for incorporation in textile warp knitting machines of any other size and fabric width capability, including for example warp knitting machines adapted for knitting fabrics up to widths of 168 inches, as well as many textile weaving machines and other textile fabric-forming machines for producing fabrics to which it may be desirable to provide a suede finish.

Figure 2:
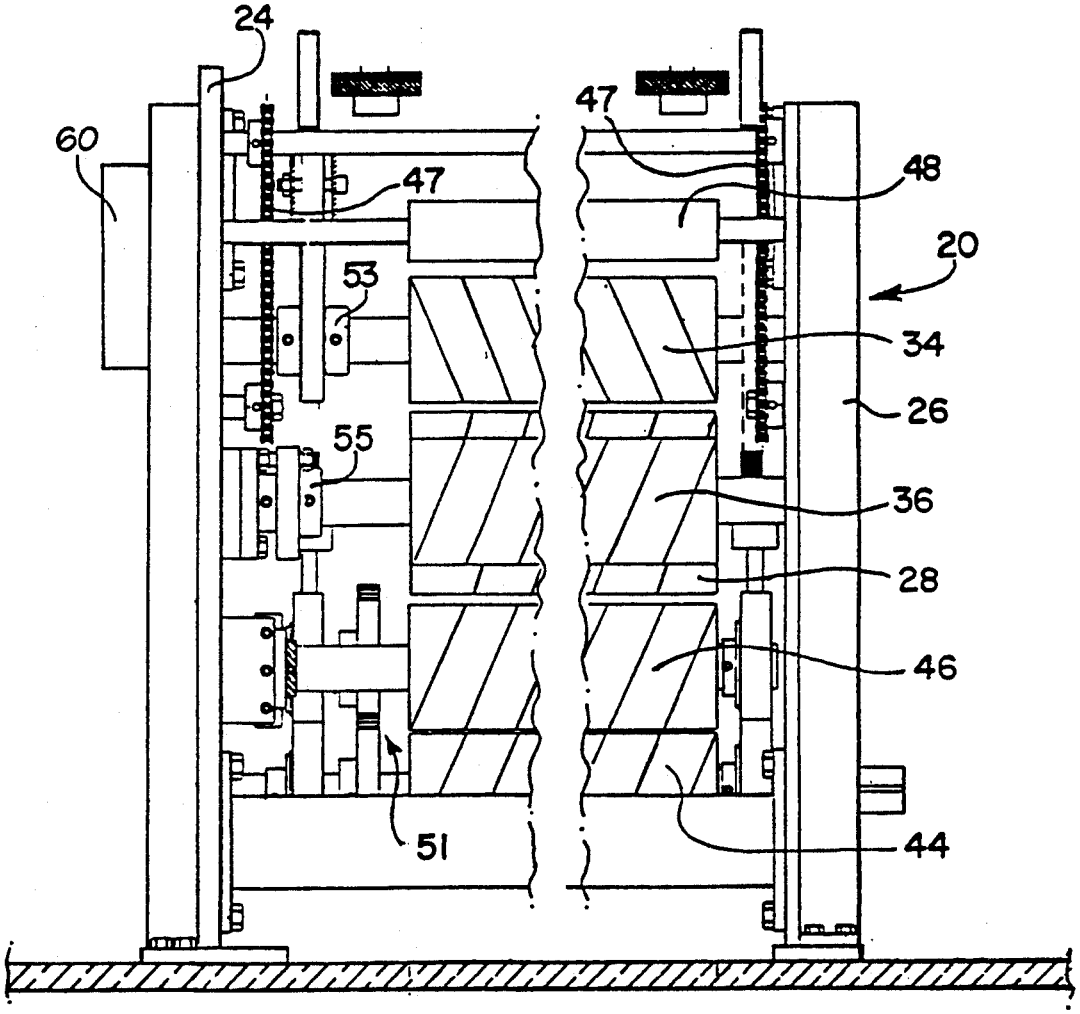
FIG. 2 is a front elevational view of the fabric take-up section of the warp knitting machine of FIG. 1, showing the sueding arrangement of the present invention as embodied therein.
Figure 3:
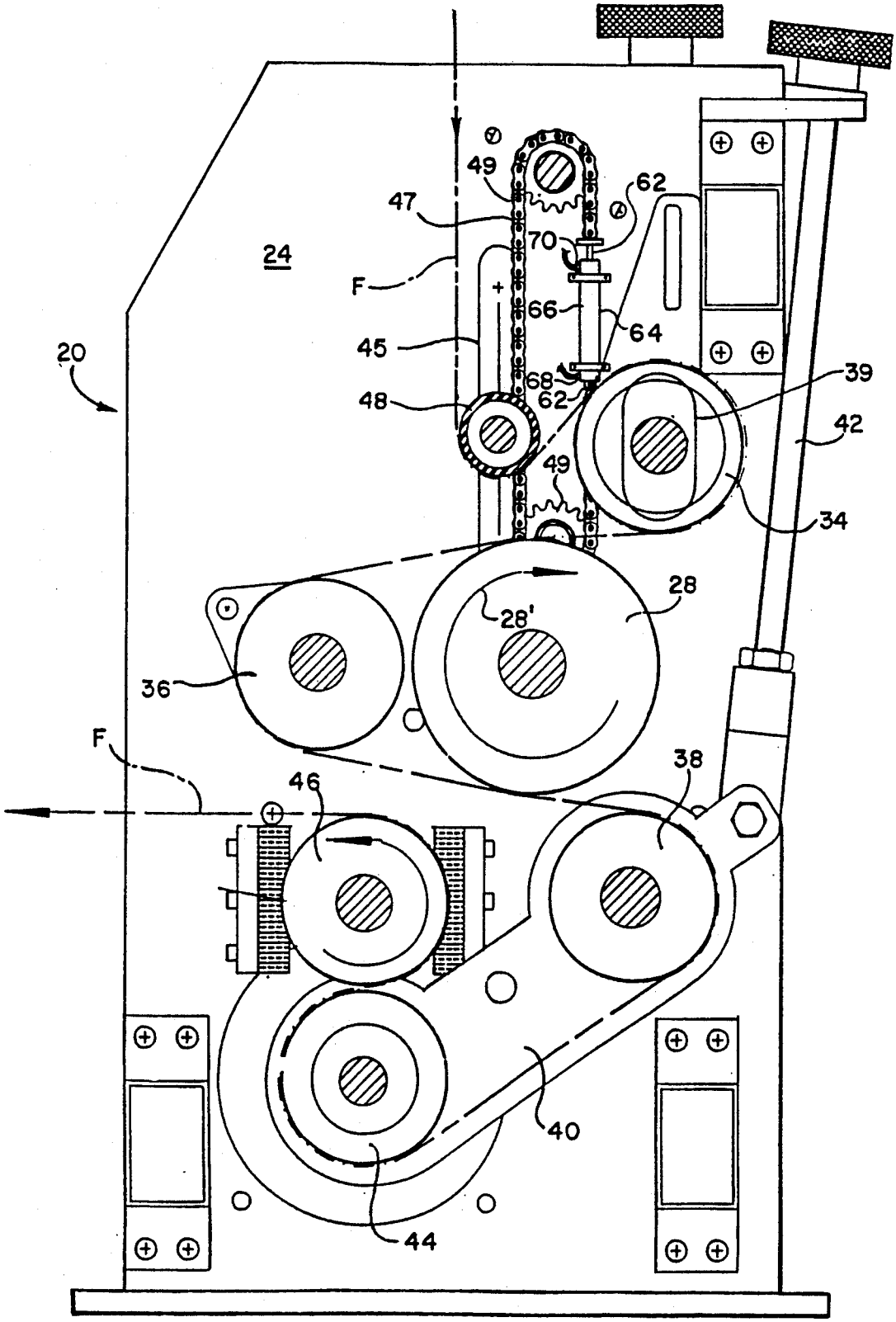
FIG. 3 is an end elevational view of the fabric take-up section and sueding arrangement of FIG. 2.

As best seen in FIGS. 2 and 3, the sueding arrangement 10 of the present invention is incorporated in the take-up section 20 of the warp knitting machine 12 for performing a sueding operation on the fabric F in its full open-width form at a location intermediate the knitting arrangement 18 and the winding of the fabric F on the storage roll 22, as more fully explained hereinafter. The take-up section 20 of the knitting machine 12 includes a pair of upright end frame members 24, 26 arranged in spaced facing relation at opposite ends of the knitting machine 12. The sueding arrangement 10 includes a sueding roll 28 rotatably mounted at its opposite ends to the end frame members 24, 26 to extend laterally therebetween. A series of three guide rolls 34, 36, 38 are similarly mounted rotatably at their opposite ends to the end frame members 24 26 to extend laterally therebetween in axially parallel relation to the sueding roll 28 in a generally triangular relation to one another at circumferential spacings about the sueding roll 28. The opposite ends of the guide roll 34 are disposed within vertically extending slots 39 formed in facing relation in the respective end frame members 24, 26 for adjusting disposition of the guide roll 34 vertically toward and away from the sueding roll 28. The opposite ends of the guide roll 38 are supported by a pair of arm members 40 respectively pivoted coaxially to the end frame members 24, 26 to be adjustably movable toward and away from the sueding roll 28 by adjusting screws 42 each extending between a respective end frame member 24, 26 and the free end of a respective pivot support arm 40. A pair of take-up rolls 44, 46 are likewise rotatably mounted at their respective ends to the end frame members 24, 26 to extend therebetween in closely spaced axially parallel relation to one another and to the sueding and guide rolls 28, 34, 36, 38, the take-up roll 44 being supported coaxially with the pivot axis of the pivot arms 40.

A dancer roll 48 is also rotatably mounted at its opposite ends to the end frame members 24, 26 in corresponding vertical slots 45 formed therein for movement in a vertical plane to compensate for fabric tension and speed fluctuations during operation of the knitting machine 12 and the sueding arrangement 10, as hereinafter described. The dancer roll 48 is connected at the opposite ends of its shaft to a pair of timing chains 47 each trained about a set of sprockets 49 to insure that the dancer roll 48 moves within the slots 45 in axially parallel relation to the sueding, guide and take-up rolls. The opposite ends of one timing chain 47 are attached, respectively, to piston shafts 62 which extend outwardly from the opposite ends of a pneumatically operated dual-acting piston-and-cylinder assembly 64 whose cylinder body 66 is affixed to the respective end frame member 24. Air intake and exhaust fittings 68, 70 are provided at opposite ends of the cylinder body 66 for actuating piston movement selectively in opposite directions to control movement of the timing chains 47 and the dancer roll 48 upwardly and downwardly within the slots 45, as hereinafter more fully explained.

As shown in FIG. 3, the fabric F is trained to travel downwardly from the knitting arrangement 18 and through the take-up section 20 initially beneath the periphery of the dancer roll 48, therefrom about the periphery of the guide roll 34, then in generally tangential peripheral surface contact with the upwardly facing side of the sueding roll 28, therefrom peripherally about the guide roll 36, then once again in generally tangential peripheral surface contact with the sueding roll 28 at its downwardly facing side, therefrom peripherally about the guide roll 38, beneath the periphery of the take-up roll 44 and over the periphery of the take-up roll 46, from which the fabric F is directed by additional guide rolls (not shown) for winding about the storage roll 22.

Figure 4:
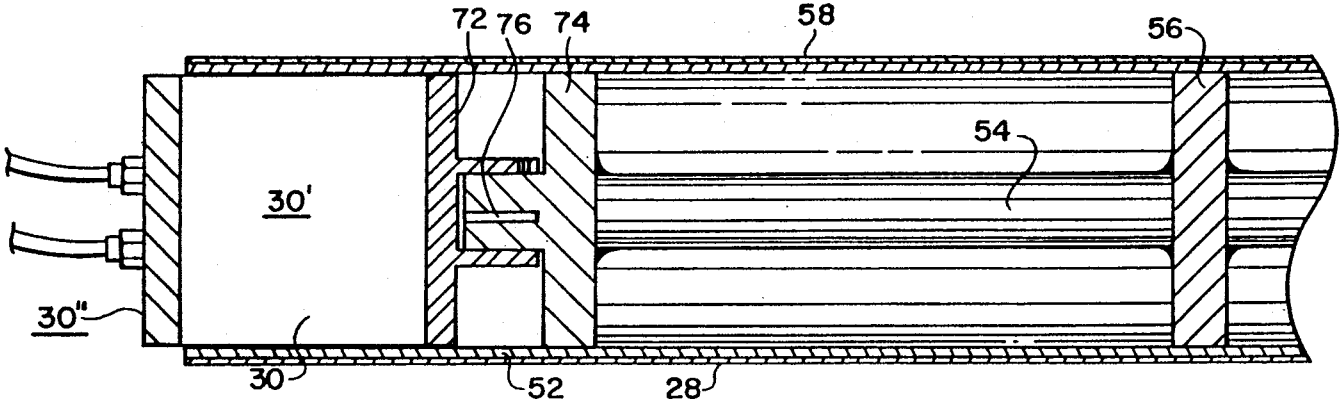
FIG. 4 is a lengthwise cross-sectional view of the sueding roll of the sueding arrangement of the present invention.
Figure 5:
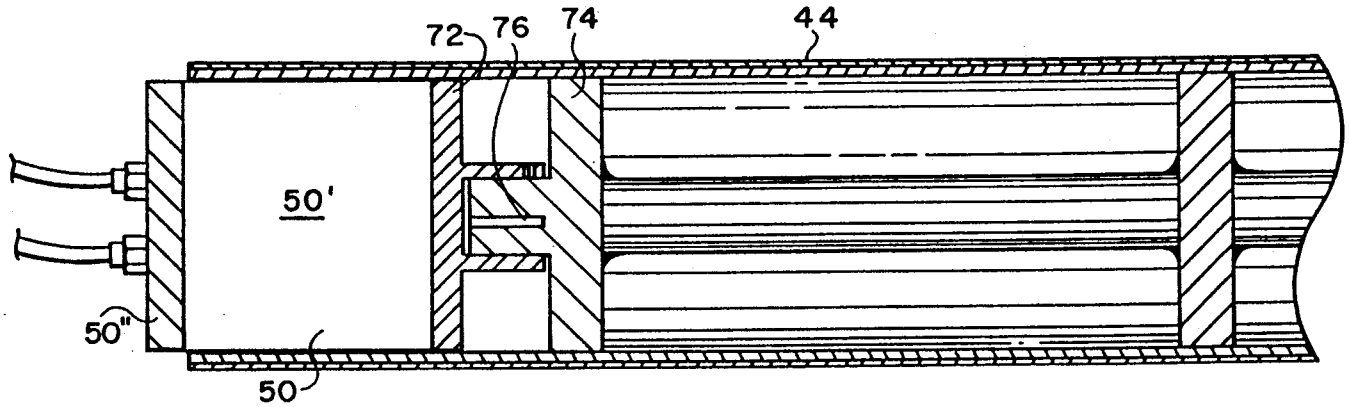
FIG. 5 is a similar lengthwise cross-sectional view of a take-up roll of the present invention.

The take-up roll 44 is driven in a clockwise direction, as viewed in FIG. 3, and through intermediate gears, indicated generally at 51 in FIG. 2, drives the guide roll 38 in the same direction, to transport the fabric F through the take-up section 20 under tension. As indicated by the directional arrow 28', the sueding roll 28 is driven to rotate clockwise, as viewed in FIG. 3, so that its peripheral surface moves opposite to the direction of travel of the fabric F at each location of contact between the fabric F and the sueding roll 28. As best seen in FIGS. 4 and 5, the sueding roll 28 and the take-up roll 44 are separately driven by individual respective drive motors 30, 50, mounted substantially entirely within a hollow end of the associated roll 28, 44. Specifically, each drive motor 30, 50 is a compact electric motor having a cylindrical rotor housing 30', 50' selected to be of a diametric dimension which will fit relatively snugly within the end of its associated roll 28, 44. Within the associated roll 28, 44, the respective rotor housing 30', 50' is affixed rigidly to the structure of the roll 28 or 44 by any suitable means of connection. By way of example but without limitation, a bracket plate 72 may be affixed to the axial end of each rotor housing 30', 50' to matingly receive a corresponding interior structural member 74 of the respective roll 28, 44, with the structural member being suitably held in integral driven relation with the bracket such as by a key 76. A stator plate 30'', 50'' is mounted at the opposite axial end of each drive motor 30, 50, respectively, and, in turn, is affixed to a respective one of the end frame members 24, 26, either directly thereto or through appropriate intermediate mounting structure. Operational control of the drive motors is provided through appropriate lead wiring, shown only representatively at 78, extending axially outwardly through each motor's stator plate 30'', 50'. A preferred form of drive motor for use of the motors 30, 50 is the brushless DC motor manufactured and sold under the trademark "DYNASERV" by Yokogawa Precision Corp. of Japan, although it is contemplated that other suitable drive motors having comparable physical and operational characteristics could be substituted.

The dancer roll 48 and each guide roll 34, 36 are freely rotatable in the direction of traveling movement of the fabric F to act as idler rolls, the respective support bearings 53, 55 (FIG. 2) for the guide rolls 34, 36 having a clutch mechanism to prevent reverse rotation to resist any tendency of the driving force of the sueding roll 28 acting through the fabric F to drive the rolls 34, 36 in the opposite direction, thereby to maintain uniform tension in the fabric F at its points of contact with the sueding roll 28.

An electronic motor controller unit 60 is also mounted to one end frame member 24, 26 and is electrically connected with the drive motors 30, 50 for actuating and controlling their respective operations, in particular their respective speeds, along with other operating components of the knitting machine 12. In addition, the motor controller unit 60 is operative in response to a tachogenerator or other suitable sensing device monitoring the speed of the main shaft of the knitting machine to maintain the drive motors 30, 50 in continuous full synchronism throughout the entire operation of the warp knitting machine 12, including particularly during start-up and stoppages of the warp knitting machine 12, such as occurs for example upon actuation of a conventional stop motion device, so that the operation of the sueding roll 28 and the fabric F accelerate and decelerate in synchronism with one another during machine starts and stoppages and otherwise to achieve a uniform sueding effect on the fabric F and thereby avoid the formation of so-called stop marks widthwise across the portion of the fabric F which travels over the sueding roll 28 during starts and stoppages of the machine and to avoid other similar fabric defects resulting from non-uniform fabric speed and tension.

The controller 60 is also operative to control the supply of pressurized air from a suitable source of supply (not shown) to the intake and exhaust fittings 68, 70 of the piston-and-cylinder assembly 64 to control upward and downward movement of the dancer roll 48. During normal operation, the controller 60 controls the supply of pressurized air to the intake fitting 68 at a sufficient air pressure to urge the dancer roll 48 downwardly into contact with the traveling fabric F with a sufficient force to impose a predetermined level of tension in the fabric F. A potentiometer or other suitable sensor (not shown) may be provided in operative association with the shaft of the dancer roll 48 to recognize movement thereof vertically within the slots 45 indicative of speed or tension fluctuations in the fabric F, the potentiometer being connected with the motor controller 60 to actuate corresponding adjustments in the driven speed of the take-up roll 44 to compensate for such fluctuations.

The construction of the sueding roll 28 is best shown in FIG. 4. To minimize the overall weight of the sueding roll 28, the roll 28 is basically of a hollow construction formed by a hollow, seamless, cylindrical outer shell 52 mounted on a central coaxially extending shaft 54 by a series of circular support walls 56 affixed radially between the shaft 54 and the interior periphery of the cylindrical shell 52 at uniform axial spacings therealong. As will be understood, the support walls 56 serve to maintain the cylindricality of the shell 52 against deformation without contributing significantly to the overall weight of the sueding roll 28. The outer periphery of the sueding roll 28 is fitted with a removable spirally-wound sleeve 58 of sandpaper or another abrasive material suitable for fabric sueding operations, or as those persons skilled in the art will understand the outer periphery of the sueding roll 28 may be otherwise formed or provided with a similarly abrasive surface character in any other appropriate manner rendering the sueding roll 28 capable for performing a sueding or sanding operation on a textile fabric.

The operation of the sueding arrangement 10 in the warp knitting machine 12 may thus be understood. In the initial set-up of the warp knitting machine 12 for a combined fabric knitting and sueding operation, the disposition of the guide roll 34 within the slots 39 in the respective end frame members 24, 26 and the pivoted disposition of the guide roll 38 as determined by the adjusting screws 42 are adjustably preset in relation to the sueding roll 28 to hold the fabric F in tensioned surface engagement with the periphery of the sueding roll 28 at its upwardly facing side whereat the fabric F first contacts the sueding roll 28 sufficient that the abrasive periphery of the sueding roll 28 essentially only will raise the constituent surface yarns of the fabric F without cutting them and to hold the fabric F in tensioned surface engagement with the periphery of the sueding roll 28 at its downwardly facing side whereat the fabric F subsequently recontacts the sueding roll 28 with a relatively greater force of engagement sufficient that the abrasive periphery of the sueding roll 28 will cut the raised constituent surface yarns of the fabric F. At the same time, the controller 60 is programmed or otherwise pre-set to deliver sufficient pressurized air to the intake fitting 68 of the piston-and-cylinder assembly 64 to generate a predetermined biasing force of the dancer roll 48 into contact with the fabric F to impose and maintain a predetermined level of tension in the fabric.

The motor controller unit 60 is preset to establish an appropriate desirable speed of operation of the knitting machine operating components, including the driven speed of the take-up roll 44, which determines the traveling speed of the fabric F through the take-up section 20, and also to establish a compatible peripheral surface speed of the sueding roll 28. As will be understood by those persons skilled in the art, the fabric take-up speed of conventional warp knitting machines may range from 10 to 50 inches per minute, sometimes more or less, depending upon the fabric being knitted. The surface speed of the sueding roll 28 when fitted with a sleeve 58 of conventional sandpaper as the abrasive media will normally range between approximately 130 and 300 inches per minute, although the sueding roll surface speed may be more or less depending upon the particular fabric, other machine operating parameters, the desired sueding effect, etc. In any event, these operational parameters of the present sueding arrangement 10 are in substantial contrast to conventional sueding and sanding machines which operate at a fabric traveling speed generally in the range of 10 to 30 yards per minute with their sueding cylinders being rotated as a peripheral surface speed in the range of 7500 inches per minute or more in a direction of peripheral movement the same as the direction of fabric travel. Thus, as the knitting machine 12 is operated to knit the fabric F at the knitting arrangement 18 and subsequently take-up the fabric F through the take-up section 20, the sueding roll 28 performs a sueding operation on the fabric F as it passes twice over the oppositely rotating abrasive periphery of the sueding roll 28.

As aforementioned, convention sueding machines disadvantageously experience relative rapid accumulation of abraded debris on their sueding rolls, necessitating frequent change of the sandpaper or other abrasive surface material. In accordance with the present invention, debris accumulation on the sandpaper surface of the sueding roll 28 is minimized by causing the fabric F to be vibrated along the extents thereof traveling in sueding contact with the upper and lower sides of the sueding roll 28 between the idler rolls 34, 36 and between the idler rolls 36, 38. Preferably, this vibrating effect is accomplished through the motor controller unit 60 by supplying the drive motor 30 to the sueding roll 2 with a primary speed control signal operative to establish the desired surface speed of the sueding roll 28, while at the same time superimposing on the main speed control signal a so-called square wave signal, so that the combined signal delivered to the sueding roll drive motor 30 causes it to repetitively fluctuate the actual driven surface speed of the sueding roll 28 slightly above and slightly below the desired average surface speed. Preferably, the square wave signal is of a relatively high frequency so that the repetitive cycling of the sueding roll surface speed occurs rapidly. The thusly-imposed vibration of the fabric F permits abraded dust particles generated by the sueding action, which otherwise would progressively accumulate and ultimately clog the abrasive surface material of the sueding roll 28, to be continuously released therefrom, thereby substantially extending the useful life of the sandpaper or other abrasive surface material.

Several distinct advantages are realized from the present invention. As will readily be appreciated, the performance of a sueding operation on the fabric F as part of the initial fabric-forming operation substantially eliminates the need for performing a subsequent separate sueding process on the fabric F using an independent sueding machine and the necessity beforehand of cutting the fabric lengthwise into fabric widths compatible with a conventional sueding machine. As such, substantial cost savings may be realized, both in reduced capital equipment costs associated with acquiring separate sueding machines an in direct fabric production costs. Also in this regard, the particular drive motors 30, 50 selected for driving the sueding and take-up rolls 28, 44, respectively, are capable of a range of possible driven speeds without the necessity of bulky speed-change gearing or transmissions which, in conjunction with the mounting of the drive motors 30, 50 substantially entirely within their respective driven rolls 28, 44, enables the supporting and driving structure for the present sueding arrangement to be mounted entirely within the lateral confines of the end frame members 24, 26 without any structure requiring additional floor space outwardly of the end frame members 24, 26, while at the same time enabling the various fabric-engaging rolls of the sueding arrangement to still have the same overall effective length as the full widthwise extent of the associated knitted or other fabric-producing machine. Additionally, due to the vibratory effect of the sueding roll drive on the fabric in conjunction with the relatively slow rotational operating speeds at which the sueding roll 28 is operated according to the present invention, the accumulation of fibrous fly, dust and like debris and waste on the abrasive periphery of the sueding roll 28 develops much more slowly so that the sandpaper sleeve or other abrasive material generally has a much more extended life than is typical with conventional sueding machines. For example, it has been found in preliminary testing that a sandpaper sleeve operated on the sueding roll 28 in a conventional warp knitting machine 12 can be expected to operate serviceably through at least three complete doffs of fabric rolls 22 from the knitting machine 12.

Of course, it will be understood that the sandpaper sleeve 58 or other abrasive material on the sueding roll 28 will gradually wear over the course of its life. It has been found that selectively increasing the peripheral surface speed of the sueding roll 28 an incremental amount following the completion of each doffing operation is effective to compensate for such wearing so that substantially uniform sueding results are achieved over the entire life of the periphery of the sueding roll. As an alternative, it may be desirable to incrementally increase the even to gradually increase its speed continuously over the life of its abrasive periphery. On the other hand, it is believed unnecessary to vary the tensioning of the fabric over the life of the sueding roll 28.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. In a textile fabric-producing machine of the type having means for manipulating yarn to form a fabric in flat open-width form and a location following the yarn manipulating means for take-up of the fabric, the improvement comprising means for sueding the fabric in full width form intermediate the yarn manipulating means and the take-up location, the sueding means comprising a sueding roll having an abrasive peripheral surface, means for directing the fabric to travel intermediate the yarn manipulating means and the take-up location in peripheral surface engagement with the sueding roll, and means for driving rotation of the sueding roll at a peripheral surface speed compatibly related to the traveling speed of the fabric, the fabric directing means including dancer roll means for monitoring tension and speed fluctuations in the fabric and adjusting the fabric directing means in relation thereto, the dancer roll means including a dancer roll and biasing means for urging the dancer roll with a predetermined force into tensioning engagement with the traveling fabric.

2. Sueding means in a textile fabric-producing machine according to claim 1 and characterized further in that the dancer roll means includes means for supporting the dancer roll for reciprocatory movement toward and away from the fabric, the dancer roll biasing means being connected to the dancer roll supporting means.

3. Sueding means in a textile fabric-producing machine according to claim 2 and characterized further in that the dancer roll biasing means includes a dual-acting piston-and-cylinder assembly.

4. In a textile fabric-producing machine of the type having means for manipulating yarn to form a fabric in flat open-width form and a location following the yarn manipulating means for take-up of the fabric, the improvement comprising means for sueding the fabric in full width form intermediate the yarn manipulating means and the take-up location, the sueding means comprising a sueding roll having an abrasive peripheral surface, means for directing the fabric to travel intermediate the yarn manipulating means and the take-up location in peripheral surface engagement with the sueding roll, and means for driving rotation of the sueding roll at a peripheral surface speed compatibly related to the traveling speed of the fabric, the sueding roll driving means including means for vibrating the traveling fabric at its location of contact with the sueding roll sufficient to allow abraded particles to be released from the sueding roll, thereby to extend the life of the sueding roll.

5. Sueding means in a textile fabric-producing machine according to claim 4 and characterized further in that the fabric vibrating means includes means for periodically varying the driven speed of the sueding roll.

6. Sueding means in a textile fabric-producing machine according to claim 5 and characterized further in that the sueding roll driving means includes a drive motor, the fabric vibrating means including means for delivering a fluctuating operating signal to the drive motor.

7. Sueding means in a textile fabric-producing machine according to claim 6 and characterized further in that the signal delivering means includes means for generating a main motor control signal and means for superimposing a square wave signal on the main motor control signal.

8. Sueding means in a textile fabric-producing machine according to claim 6 and characterized further in that the fabric directing means includes a first fabric guide roll in advance of the sueding roll, a second fabric guide roll following the sueding roll, and means for preventing rotation of the guide rolls in opposition to the direction of fabric travel.

9. In a textile fabric-producing machine of the type having means for manipulating yarn to form a fabric in flat open-width form and a location following the yarn manipulating means for take-up of the fabric, the improvement comprising means for sueding the fabric in full width form intermediate the yarn manipulating means and the take-up location, the sueding means comprising a sueding roll having an abrasive peripheral surface, means for directing the fabric to travel intermediate the yarn manipulating means and the take-up location in peripheral surface engagement with the sueding roll, and means for driving rotation of the sueding roll at a peripheral surface speed compatibly related to the traveling speed of the fabric, the sueding roll having a hollow drive end and the sueding roll driving means comprising a drive motor housed substantially entirely within the hollow drive end of the sueding roll.

10. Sueding means in a textile fabric-producing machine according to claim 9 and characterized by a fabric take-up roll at the take-up location and means for driving rotation of the take-up roll, the take-up roll having a hollow drive end and the take-up roll driving mean comprising a drive motor housed within the hollow drive end of the sueding roll.

* * * * *